United States Patent [19]

Wilson

[11] 4,334,616

[45] Jun. 15, 1982

[54] NESTABLE-STACKABLE PLASTIC RECEPTACLE

[76] Inventor: James D. Wilson, 421 Vista Suerte, Newport Beach, Calif. 92660

[21] Appl. No.: 273,242

[22] Filed: Jun. 12, 1981

Related U.S. Application Data

[63] Continuation-in-part of Ser. No. 123,664, Feb. 22, 1980, abandoned.

[51] Int. Cl.[3] ..... B65D 21/04

[52] U.S. Cl. ..... 206/505; 206/507

[58] Field of Search ..... 206/505, 507

[56] References Cited

U.S. PATENT DOCUMENTS

| | | | |
|---|---|---|---|
| 3,937,327 | 2/1976 | Carroll | 206/507 |
| 4,000,817 | 1/1977 | Sanders | 206/505 |
| 4,102,453 | 7/1978 | Carroll et al. | 206/507 |

*Primary Examiner*—George E. Lowrance
*Attorney, Agent, or Firm*—Keith D. Beecher

[57] ABSTRACT

A plastic receptacle or basket is provided for transporting, storing and displaying bakery, and other products, and which may be stacked on top of other like receptacles at three different levels. The receptacle of the invention is constructed so that it may be stacked on another like receptacle at a first and a second stacking level without any need to slide or rotate the receptacles with respect to one another so that the receptacles may be conveniently stacked at the bakery manually or by simple mechanical means, or in the route trucks where space is at a premium. In addition, the receptacles may be stacked at a third stacking level, if so desired, by rotating the receptacles 180° with respect to one another from position of first and second stacking levels.

5 Claims, 13 Drawing Figures

2nd STACK POSITION ALL BASKETS FACING SAME WAY STRAIGHT UP & DOWN

3rd STACK POSITION ALTERNATE EVERY OTHER BASKET STRAIGHT UP & DOWN

NESTABLE-STACKABLE PLASTIC RECEPTACLE

This application is a continuation-in-part of Copending Application Ser. No. 123,644, filed Feb. 22, 1980, now abandoned.

BACKGROUND

The receptacle of the present invention may be formed, for example, of plastic or sheet metal, and it is constructed so that it may be stacked on other like receptacles at different stacking levels when filled with products, or nested into like receptacles when empty so as to conserve space. The receptacles of the invention are intended primarily for use in the food industry, although they have general application in a wide variety of plants, warehouses, transportation vehicles, and the like.

The receptacles of the invention may be used, for example, in transporting and displaying bakery, or other goods. For example, a plurality of the receptacles may be loaded at the bakery with bakery goods and stacked on top of one another at the second stacking level by simple mechanical means, and they may then be transported in a stacked condition to the retail stores or markets. The stacked receptacles may then be positioned on the floor of the store or market so that the merchandise therein may be displayed and purchased. When the receptacles are empty, they may be stacked on one another at the first stacking level (nesting position) for space conservation purposes, and then returned to the bakery. Also, for higher bakery products, the receptacles may be stacked on top of one another at the third stacking level with a greater displacement than the second stacking level, this being achieved by rotating each receptacle at 180° with respect to the preceding receptacle during the stacking operation.

The receptacles may also be stacked on top of one another in a longitudinally offset relationship and the resulting tier may be supported in a tilted position, such as illustrated and described in U.S. Pat. No. 3,083,879. In this manner the products in the individual receptacles move to the forward end of each receptacle by gravity feed as the products are removed. Moreover the receptacles may be stacked in a staggered relationship, if so desired.

The particular nestable and stackable receptacle of the present invention is advantageous in that it is capable of being nested or stacked without the need for moving bails or other movable parts, and without the need to slide the receptacles with respect to one another. Moreover, insofar as the second and third stacking levels are concerned, the receptacles may be stacked with a horizontal rotating motion so that simple automatic stacking machinery may be used. The improved receptacle to be described stacks with like receptacles in vertical alignment for optimum space conservation when in either the stacked condition or in the nested condition, or it may be offset, as mentioned above, for gravity feed, or stacked in a staggered relationship.

The receptacle of the invention preferably is formed of molded plastic, such as injection molded polypropylene, so as to be light, rugged and inexpensive in its construction. As will be described, the receptacle is capable of being stacked with other like receptacles at three distinct stacking levels to form, in each instance, a rigid and stable tier.

The receptacle of the invention is constructed so that merchandise therein may be readily accessible when the receptacle is stacked into a tier with other like receptacles, the merchandise being removable from the open ends of any of the receptacles of the tier without disturbing the other receptacles.

A particular unique feature of the receptacle of the present invention is that it may be stacked on other like receptacles, at two of its three stacking levels, by means of a simple operation, without any need to rotate or slide the receptacle relative to the other receptacles insofar as the first stacking level is concerned.

The receptacle of the present invention is of the same general type as the receptacle described and claimed in U.S. Pat. Nos. 3,219,232; 3,398,840 and 3,608,921, all of which have issued in the name of the present inventor.

DETAILED DESCRIPTION OF THE ILLUSTRATED EMBODIMENT

Figure 1:
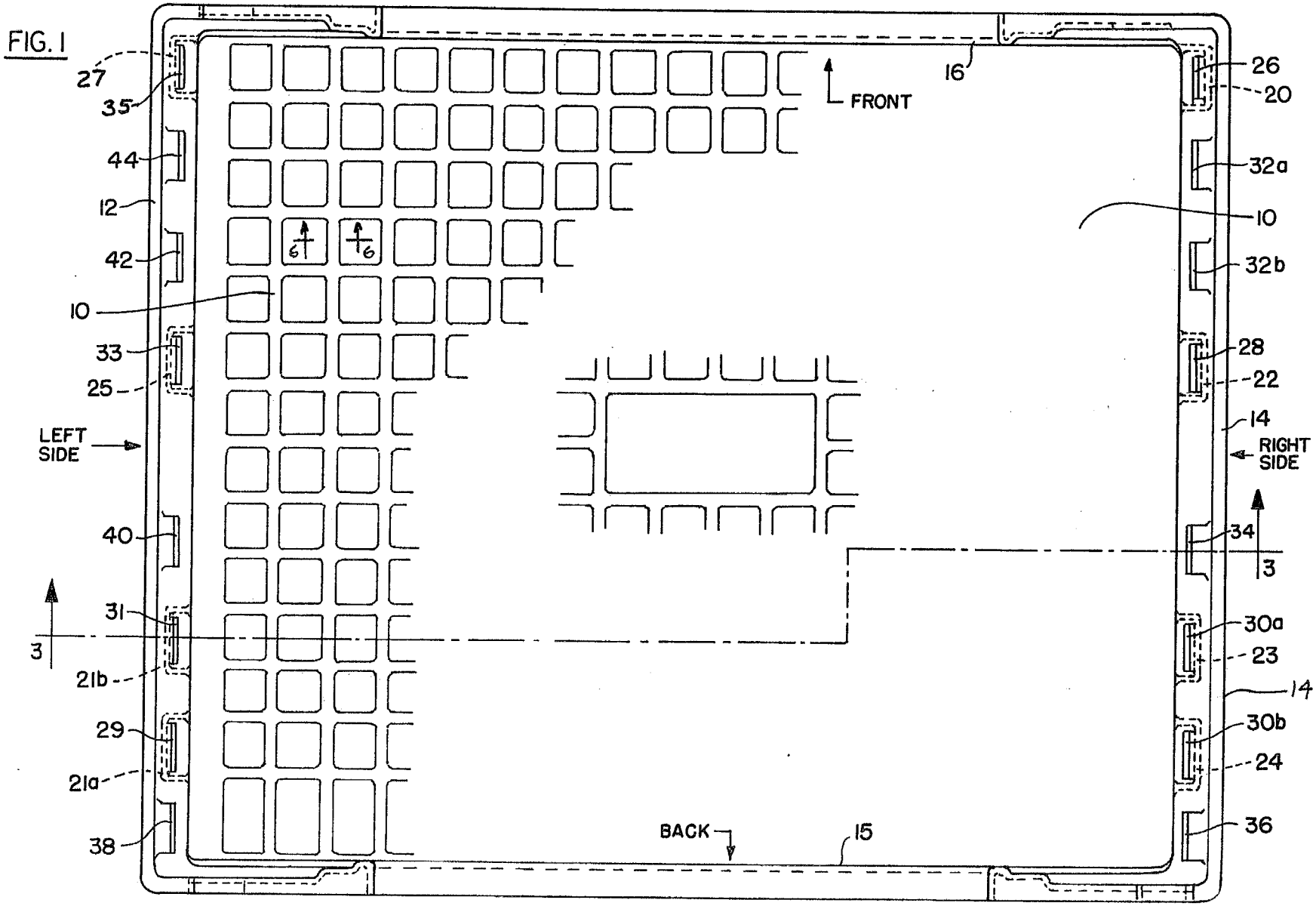
FIG. 1 is a top plan view of a receptacle constructed in accordance with one embodiment of the invention.
Figure 2:
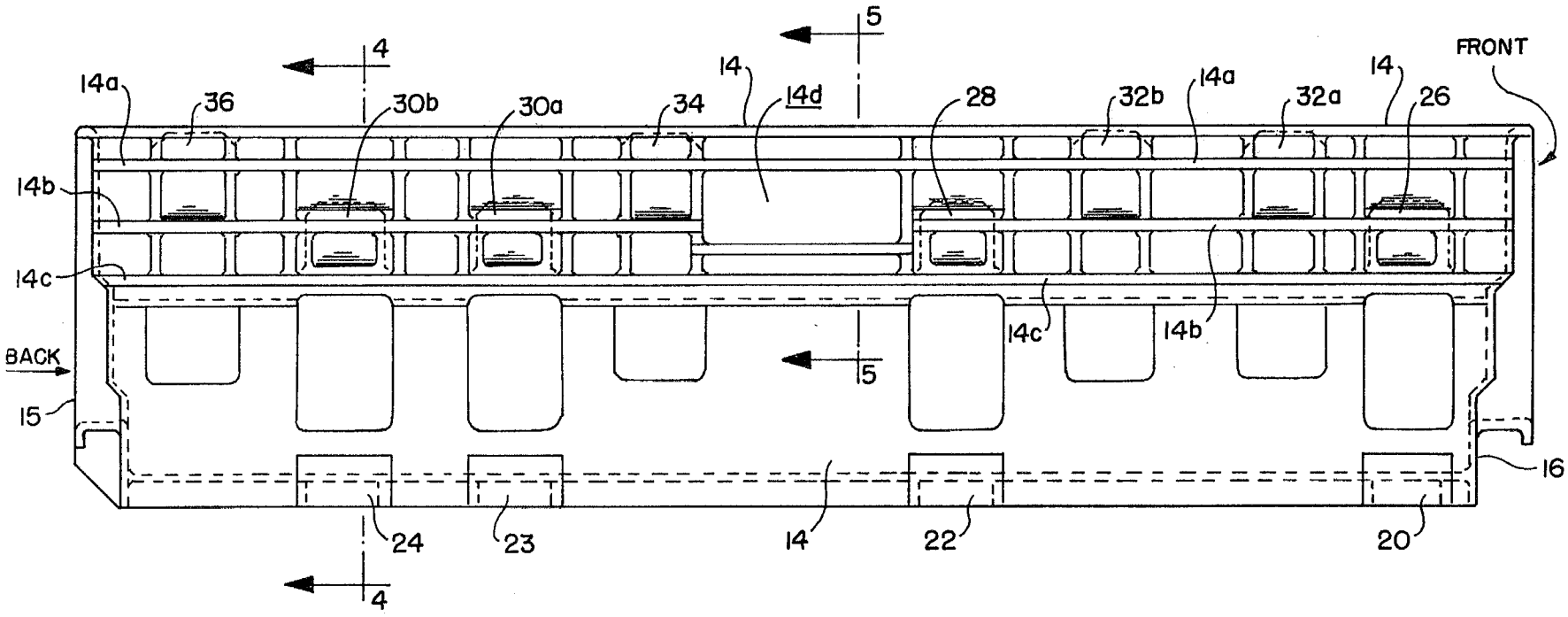
FIG. 2 is a side elevational view of the receptacle of FIG. 1.
Figure 3:
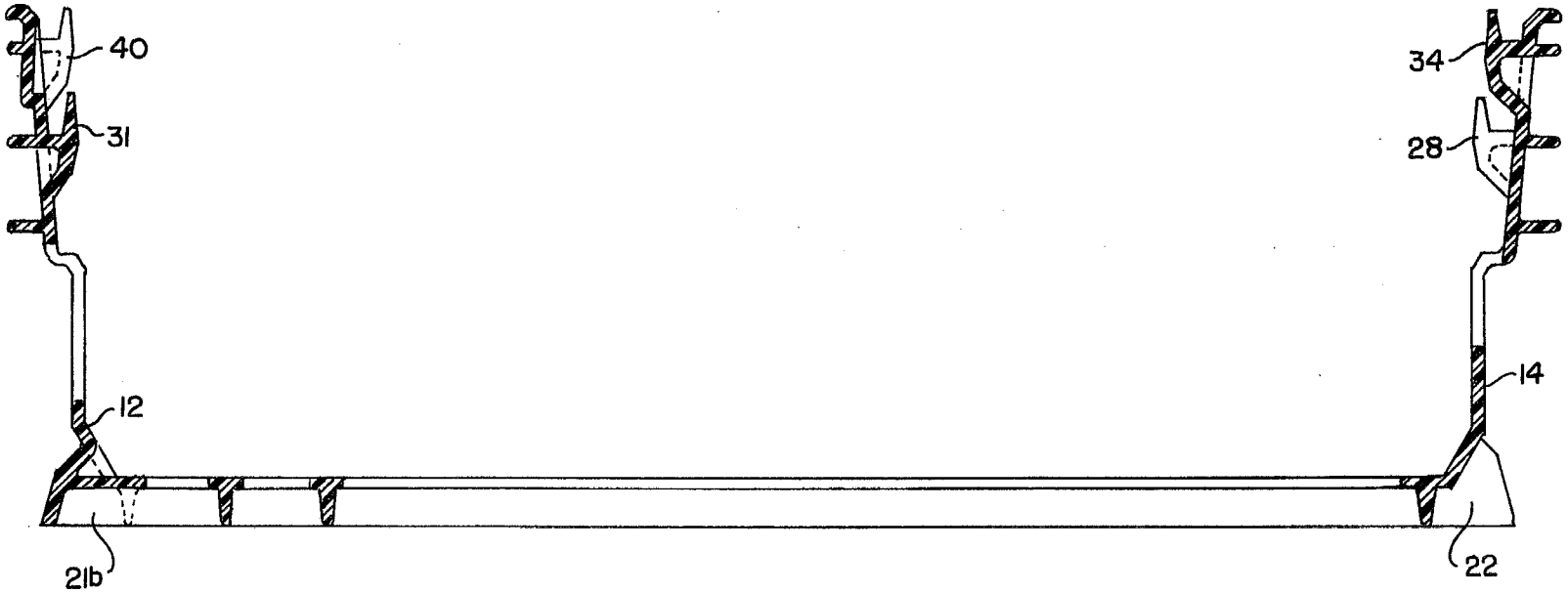
FIGS. 3–6 are sectional views of the receptacle taken along the lines 3—3, 4—4, 5—5 and 6—6 of FIGS. 1 and 2.
Figure 6:
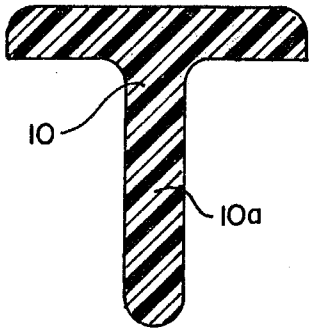
Figure 5:
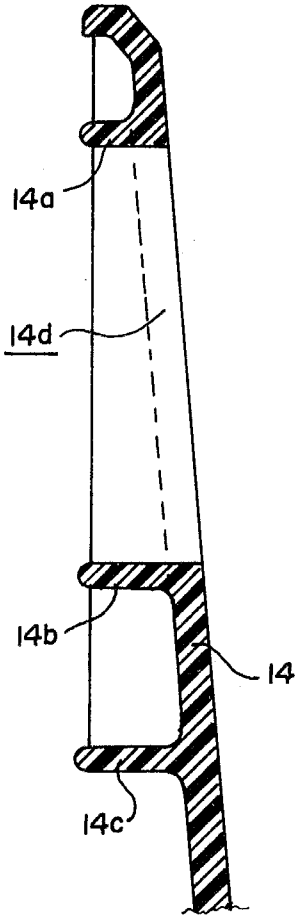
Figure 7:
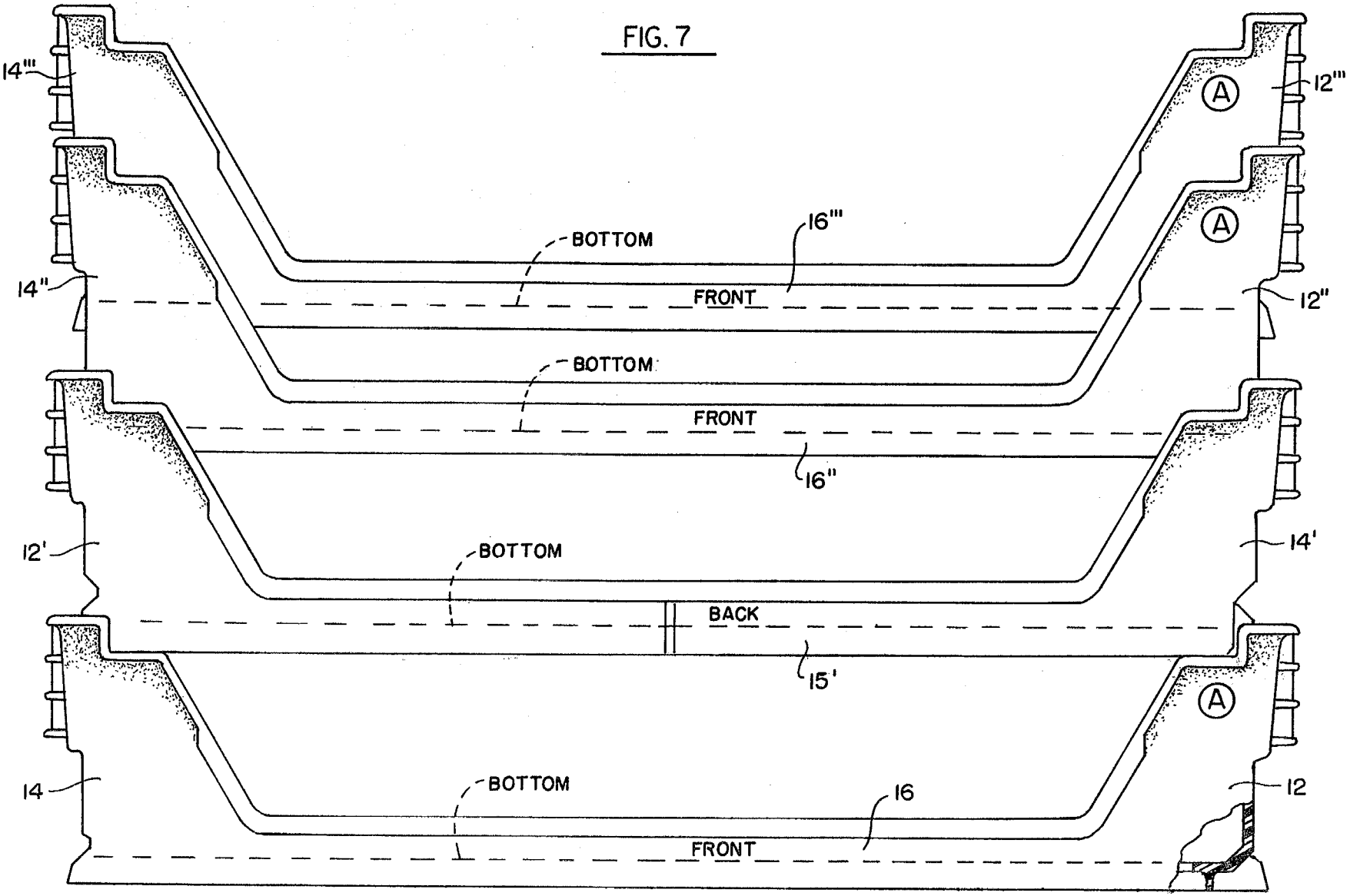
FIG. 7 is an end view of a number of receptacles of the type shown in FIGS. 1 and 2 stacked on one another at different stacking levels.
Figure 10:
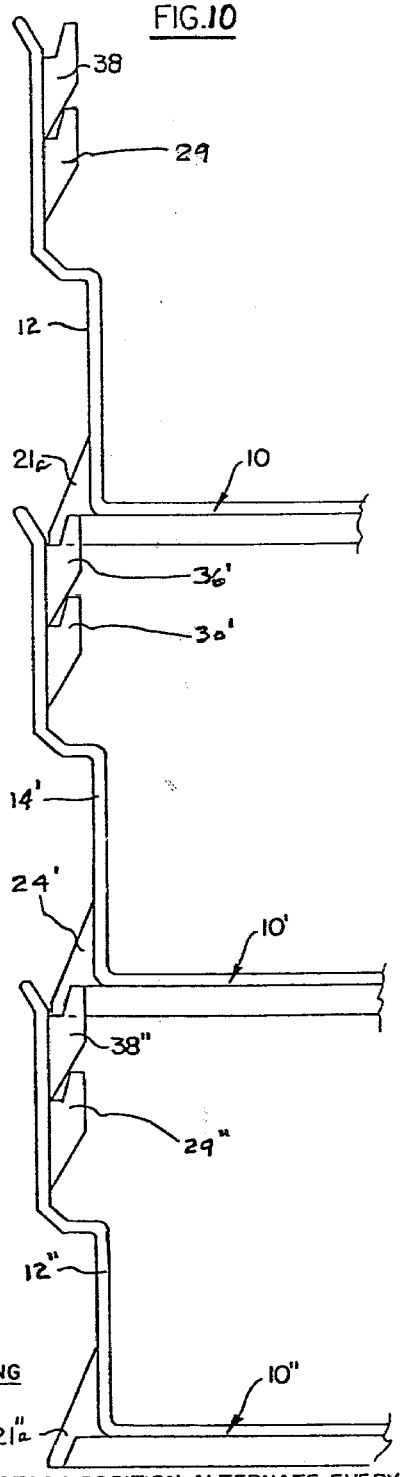
Figure 11:
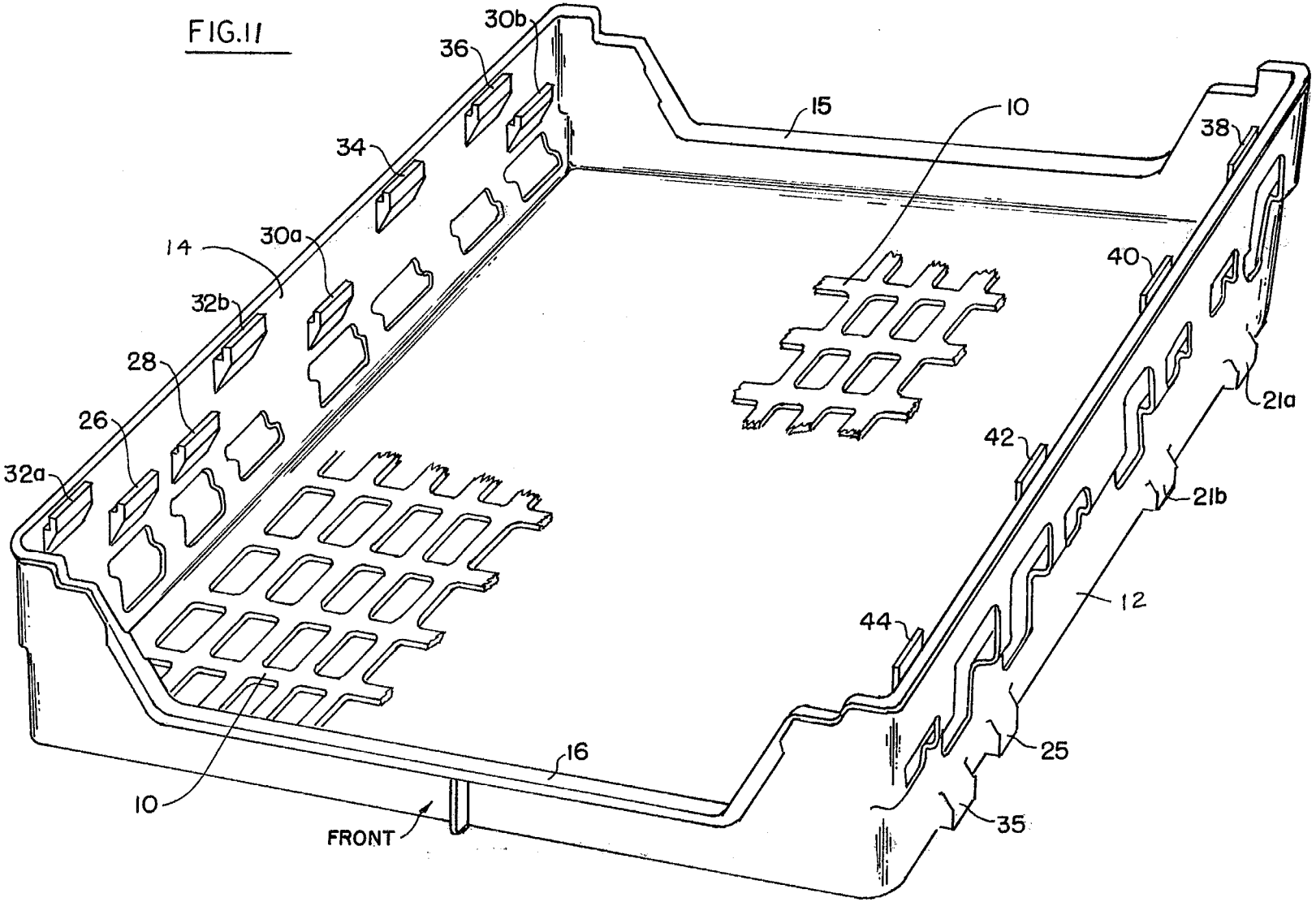
FIG. 11 is a perspective view of the receptacle of FIGS. 1 and 2.
Figure 12:
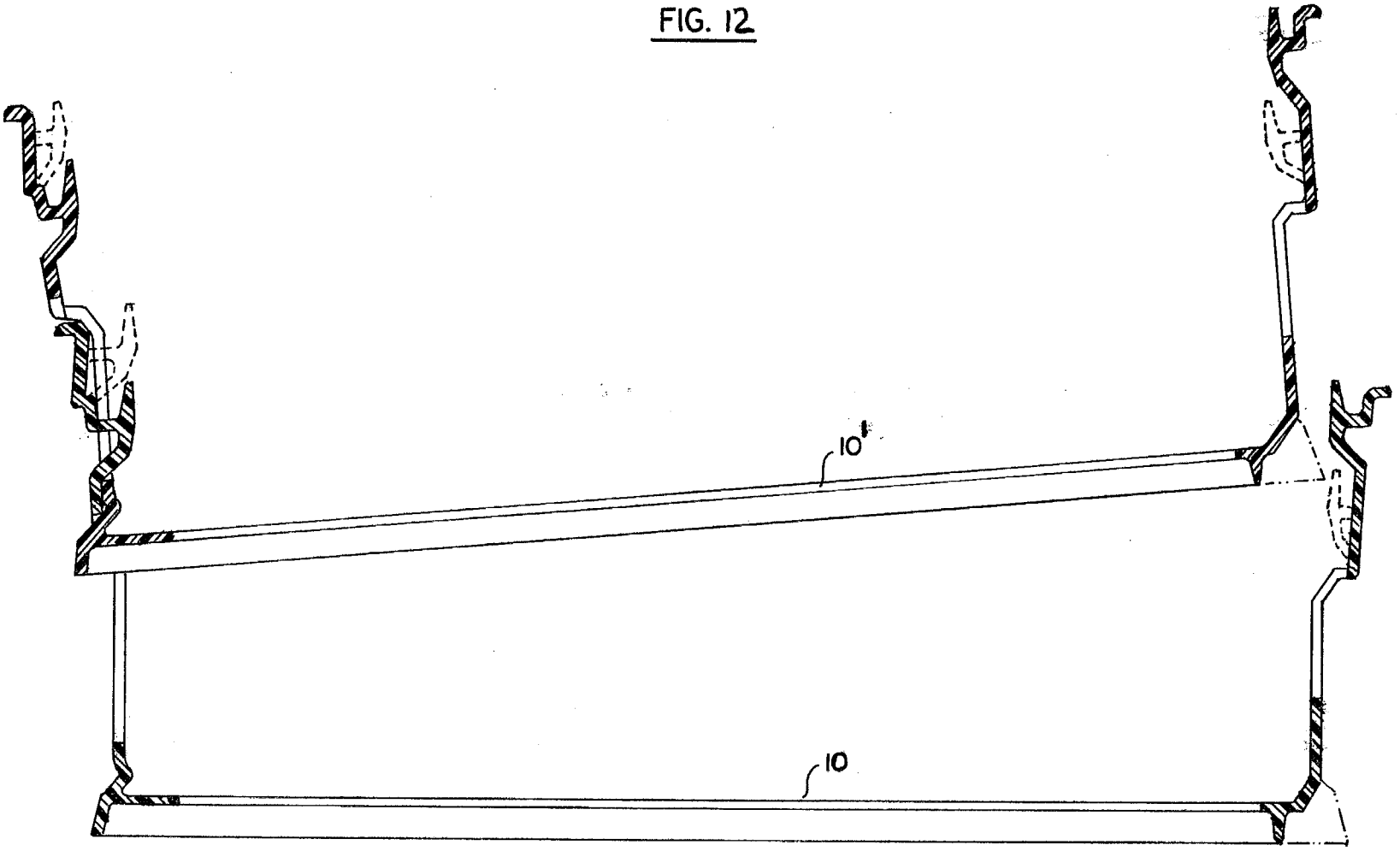
FIG. 12 is a sectional view of two receptacles in the process of being nested within one another.

The receptacle shown in FIGS. 1, 2 and 12 of the drawings, as mentioned above, is adapted to be stacked with like receptacles at three distinct stacking levels, which are shown in FIG. 7, and sectional views of which are shown in FIGS. 8–11. The receptacle is preferably molded as a single integral unit to be formed of an appropriate plastic material such as polypropylene and formed by injection molding techniques.

As shown in FIGS. 1, 2 and 11, the receptacle includes a bottom 10, a pair of side walls 12 and 14 integral with the bottom, and a pair of end walls 15 and 16 integral with the bottom and adjoining side walls, the end walls being of reduced height as compared with the side walls to permit access to the receptacle when it has other like receptacles stacked on top of it. The bottom of the receptacle, as illustrated in FIGS. 1–6, 11 may have a multiplicity of apertures therein so as to reduce its weight as much as possible.

The side walls 12 and 14 each has multi-level stacking means formed on the inner and outer surfaces thereof. The stacking means comprises a plurality of outwardly protruding lower stacking lugs or feet designated 20, 22, 23 and 24 formed on the outer surface of side wall 14 adjacent to the lower edge thereof; and a plurality of outwardly protruding lower stacking lugs or feet **21*a*, 21*b*, 25 and 27 formed on the outer surface of side wall 12** adjacent the lower edge thereof. The stacking means also includes a plurality of intermediate stacking lugs 29, 31, 33 and 35 formed on the inner surface of side wall 12, and a plurality of intermediate stacking lugs 26, 28 and 30*a* and 30*b* formed on the inner surface of side wall 14. The stacking means also includes a plurality of upper stacking lugs 38, 40, 42 and 44 formed on the inner surface of side wall 12, and a plurality of upper stacking lugs 32*a*, 32*b*, 34 and 36 formed on the inner surface of side wall 14.

Figure 4:
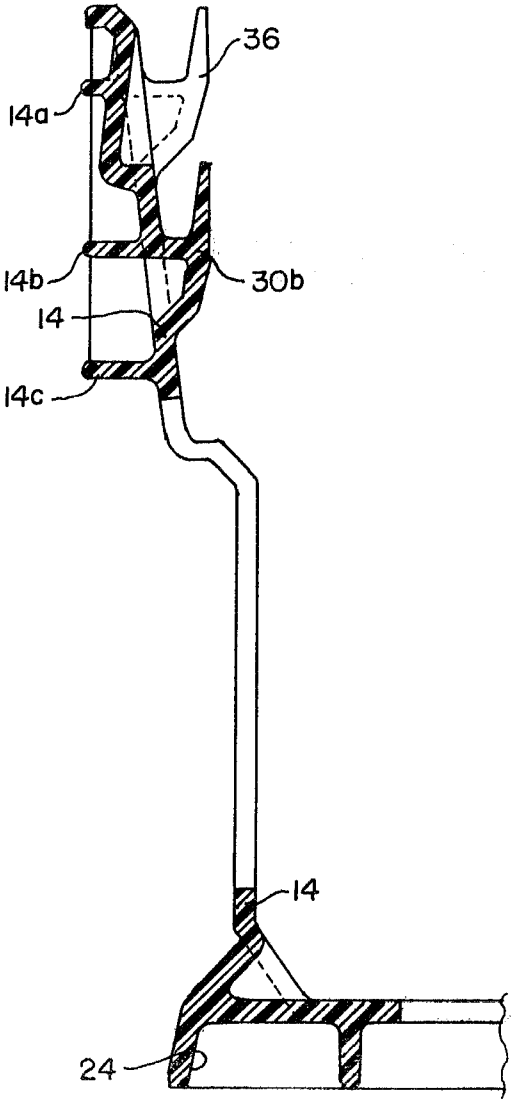

The configuration of the lower stacking lugs or feet, and of the intermediate and upper stacking lugs, is shown, for example, in FIG. 11. The side walls 12 and 14, as shown, for example, in FIG. 4 are equipped with longitudinally extending ribs, such as ribs 14*a*, 14*b* and 14*c* which serve as reinforcing means for the side walls. Each side wall is provided with an opening, such as opening 14*d* in side wall 14 (FIGS. 2 and 5) to provide appropriate means for facilitating the manual handling of the receptacle. Ribs are also formed in the bottom 10, designated 10*a* in FIG. 6.

As stated above, the receptacle shown in FIGS. 1, 2 and 11 may be stacked on other like receptacles at three different stacking levels or positions. These positions are shown in FIG. 7. In FIG. 7, the second receptacle of the tier is stacked on the lowermost receptacle by turning the second receptacle 180°, and stacking it on the lowermost receptacle in a manner to be described. The third receptacle of the tier is stacked on the second receptacle at an intermediate product height, by turning it through 180° with respect to the second receptacle, and stacking it on the second receptacle, in a manner also to be described. Likewise, the fourth receptacle shown in FIG. 7 is stacked on the third receptacle at the nested, or lowermost stacking level, in a manner likewise to be described in conjunction with FIGS. 8–10.

Figure 8:
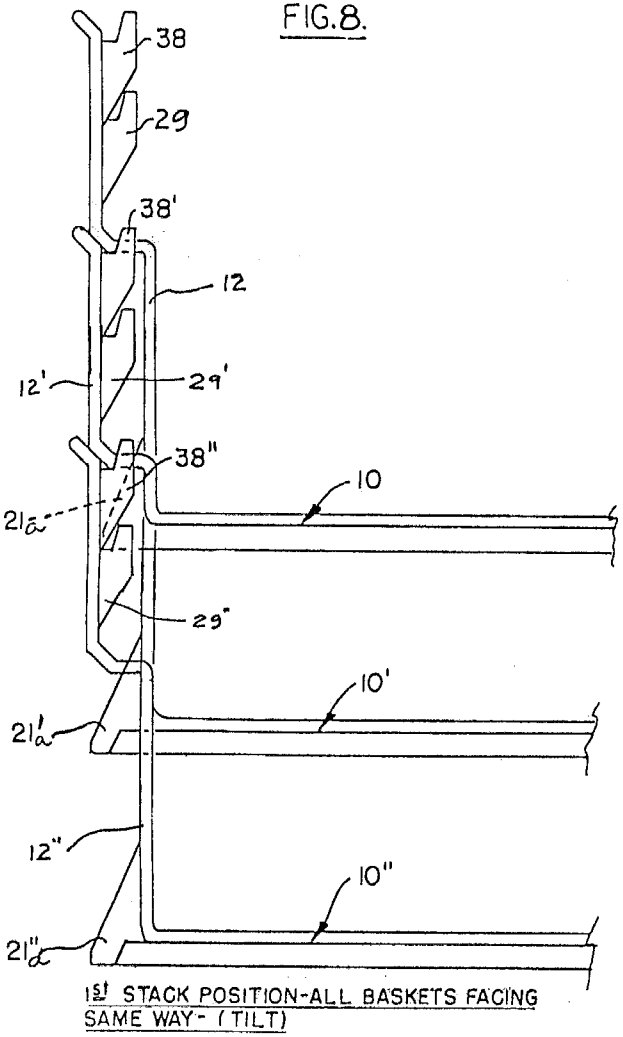
FIGS. 8–10 are partial front elevational views of a number of receptacles of the type shown in FIGS. 1 and 2 in various stacked positions.
Figure 9:
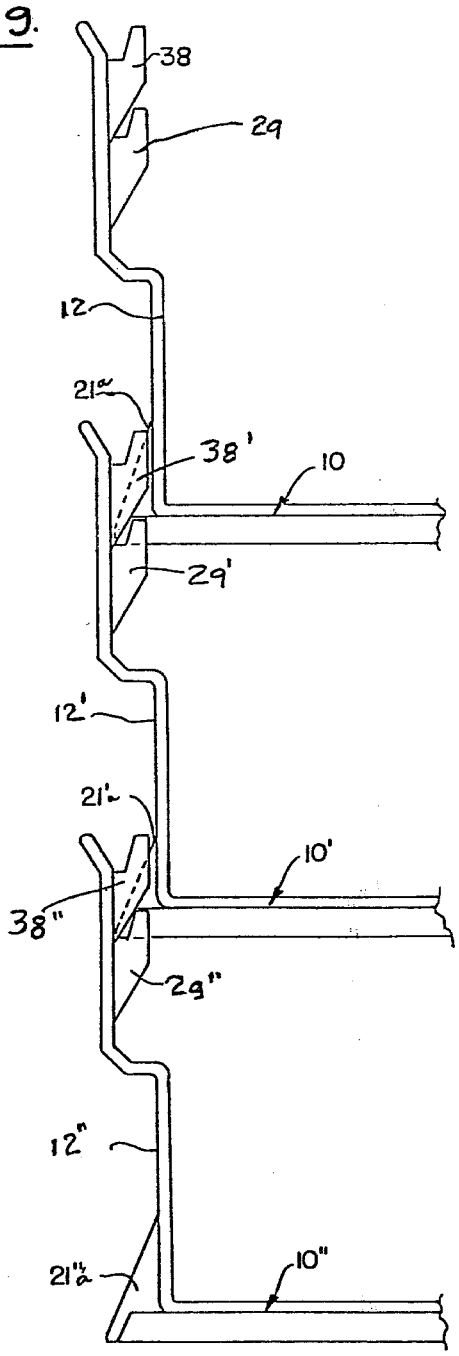

The four receptacles shown in FIG. 7 have corresponding parts identified by the same numbers correspondingly primed, and the parts of the three receptacles shown in FIGS. 8–10 are similarly identified.

Figure 13:
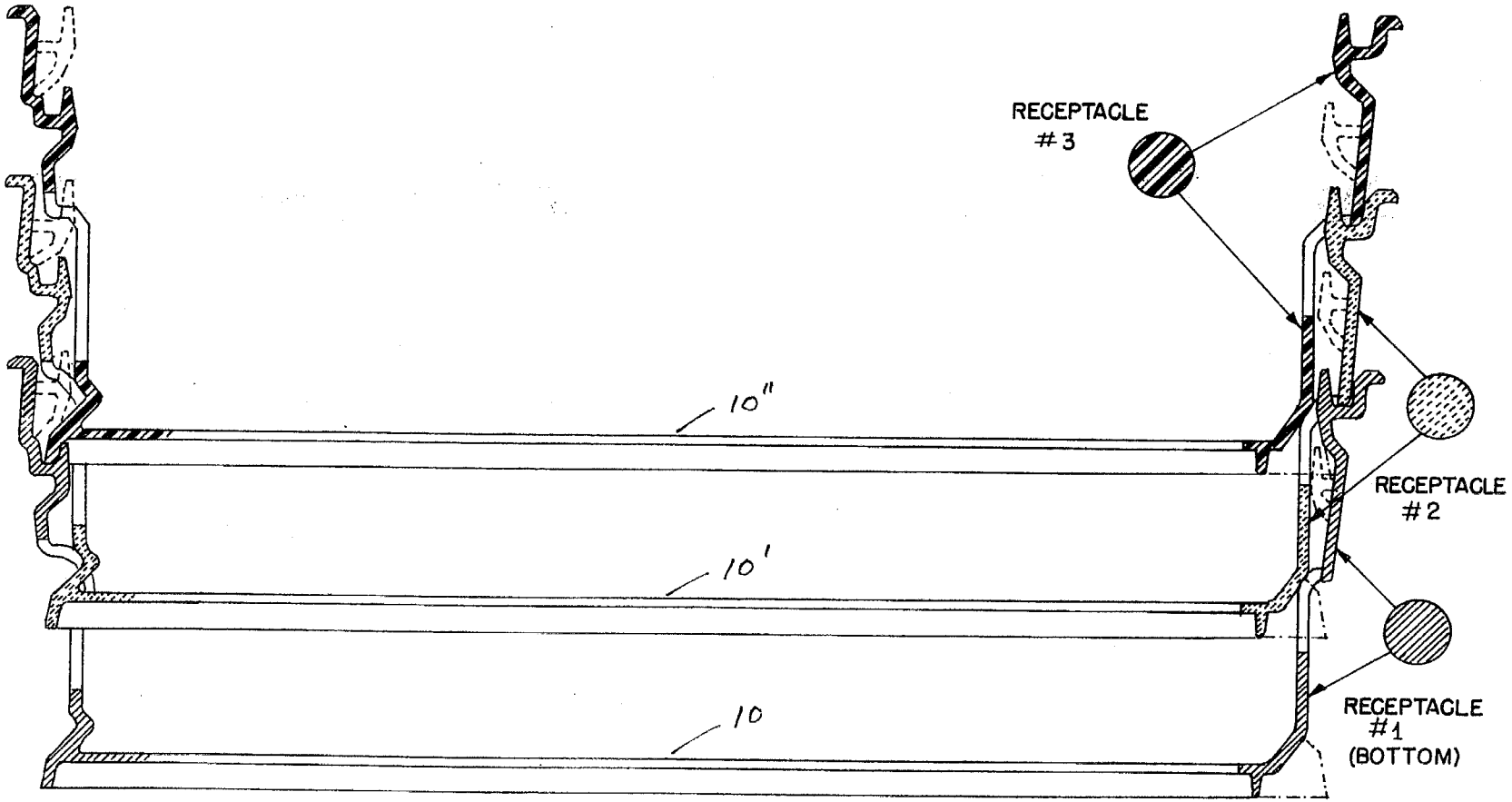
FIG. 13 is a sectional view of three receptacles nested within one another.

The three receptacles of FIG. 8 are shown in their first stacking, or nested, position, corresponding to the upper two receptacles shown in FIG. 7, and in which all the receptacles are facing in the same direction. The three nested receptacles are also shown in FIG. 13. The receptacles are nested in the representation of FIG. 8, all with the same orientation, by tilting each receptacle slightly (see FIG. 12) so that, in each instance, the upper stacking lugs 38, 40, 42 and 44 of the lower receptacle pass through corresponding holes in the side wall 12 of the upper receptacle, thus allowing the upper receptacle to move down to an inclined position with respect to the lower receptacle so that normally interfering feet and lugs may pass by one another as the upper side 14 of the upper container is lowered into a horizontal position shown in FIG. 8 within the lower receptacle.

At this point, and when a third container is similarly manipulated into the position shown in FIG. 8, the lower stacking feet, such as foot 21*a* of the uppermost receptacle engage the intermediate stacking lugs, such as lug 29″, of the lowermost receptacle which creates a solid stacking means for the uppermost receptacle. Accordingly, the uppermost receptacle, instead of resting on the second receptacle, rests in a non-jambing relationship on the lower-most receptacle, and this relationship continues as more receptacles are stacked in the tiers of FIGS. 8 and 13.

The second stacking position or level of the receptacles, such as shown in FIG. 9, is also shown in FIG. 7. To stack the receptacles in the position shown in FIG. 9, the lower stacking feet of each receptacle is placed on the intermediate stacking lugs of the next lower receptacle, so that the lower stacking feet 20, 22, 23 and 24 of side 14 of the upper receptacle (FIG. 2) are received by intermediate stacking lugs 26′, 28′, 30*a*′, and 30*b*′ of side 14′ of the lower receptacle; and the lower stacking feet 21*a*, 21*b*, 25 and 27 of wall 12 (FIG. 11) of the upper receptacle are received by the intermediate stacking lugs 29′, 31′, 33′ and 35′ of the lower receptacle, and so on, as shown in FIG. 9. As mentioned above, the stacking relationship of FIG. 9 is achieved by placing each receptacle on a lower receptacle with the same orientation, without any need to tilt, or slide or rotate the receptacles.

Similarly, a third stacking level, which is greater than the stacking level of FIG. 9 is achieved as shown in FIG. 10, by stacking each successive receptacle on a lower receptacle, and turning each successive receptacle through 180°, this stacking level corresponding to the full product height shown by the two lower receptacles in FIG. 7. Again, the stacking in FIG. 10 is achieved merely by placing one receptacle on another so that the lower stacking feet 21*a*, 21*b*, 31, 33 and 35 of wall 12 of the upper receptacle (FIG. 11), and the lower stacking feet 20, 22, 23, and 24 of wall 14 of the upper receptacle (FIG. 2), are received by the upper stacking lugs 36′, 34′, 32*a*′ and 32*b*′ of wall 14′; and by the upper stacking lugs 44′, 42′, 40 and 38′ of wall 12′ of the lower receptacle, and so on.

Accordingly, a maximum product height stacking level may be achieved, as shown in FIG. 10, merely by placing the lower stacking feet of each receptacle on the upper stacking lugs of the next lower receptacle, by first orienting the receptacles in the tier in a 180° relationship with one another. A second stacking level, lower than the previous stacking level, may be achieved by placing each receptacle, as shown in FIG. 9, on a lower receptacle, with the same orientation, so that the lower stacking feet of each receptacle is received and supported by the intermediate stacking lugs of the next lower receptacle.

An important feature of the receptacle of the invention is the fact that it may be manipulated easily and smoothly to stack it on top of a like receptacle at the various stacking levels. Another feature of the receptacle is its simplicity, which enables it to be molded and manufactured at a relatively low cost.

While a particular embodiment of the invention has been shown and described, modifications may be made. The following claims are intended to cover the modifications which come within the spirit and scope of the invention.

What is claimed is:

1. A receptacle adapted to be stacked at a plurality of different stacking levels on a like receptacle, said receptacle comprising: a bottom; a pair of opposing side walls integral with said bottom; a plurality of discrete upper stacking lugs formed on the inner surface of each of said side walls at the upper edge thereof at spaced positions along said upper edge; a plurality of discrete lower stacking lugs formed at the lower edge of each of said side walls on the outer surface thereof at spaced positions along said lower edge; and a plurality of discrete intermediate stacking lugs formed on the inner surface of each of said side walls between the upper and lower edges thereof and disposed at spaced positions along each of said side walls and displaced longitudinally from corresponding ones of said upper stacking lugs, two of the intermediate stacking lugs on each of said walls being interposed between two of the upper stacking lugs thereon, and two of the upper stacking lugs on each side wall being interposed between two of the intermediate stacking lugs thereon; said lower stacking lugs being positioned in vertical alignment with the stacking lugs of one of the other pluralities; and said side walls defining openings therein located under the stacking lugs of said upper and intermediate stacking lugs for receiving the stacking lugs of the like receptacle.

2. The receptacle defined in claim 1, in which the lower stacking lugs are in the form of downwardly facing feet.

3. The receptacle defined in claim 2, in which the upper stacking lugs formed on the inner surface of each of said side walls extend upwardly.

4. The receptacle defined in claim 2, in which the upper and intermediate stacking lugs formed on the inner surface of each of said side walls both extend upwardly.

5. The receptacle defined in claim 2, in which the lower stacking lugs are vertically aligned with the intermediate stacking lugs.

* * * * *